US007722314B2

(12) United States Patent
Burdgick

(10) Patent No.: US 7,722,314 B2
(45) Date of Patent: May 25, 2010

(54) METHODS AND SYSTEMS FOR ASSEMBLING A TURBINE

(75) Inventor: Steven Sebastian Burdgick, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 346 days.

(21) Appl. No.: 11/425,782

(22) Filed: Jun. 22, 2006

(65) Prior Publication Data

US 2007/0297899 A1 Dec. 27, 2007

(51) Int. Cl.
*F01D 11/00* (2006.01)
*F01D 9/04* (2006.01)
*F01D 17/00* (2006.01)

(52) U.S. Cl. ..... 415/108; 415/103; 415/144; 415/209.2; 415/214.1; 29/889.2; 29/889.22

(58) Field of Classification Search ..... 415/189–190, 415/100, 103, 108, 144, 145, 209.2, 209.3, 415/209.4, 210.1, 214.1; 29/889.2, 889.22
See application file for complete search history.

(56) References Cited

U.S. PATENT DOCUMENTS 3,360,189 A * 12/1967 Cook ..... 415/144
3,724,969 A 4/1973 Shulock
3,844,675 A * 10/1974 Remberg ..... 415/108
3,937,589 A * 2/1976 Remberg ..... 415/214.1
4,177,003 A * 12/1979 Remberg et al. ..... 415/108
4,274,805 A * 6/1981 Holmes ..... 415/138
4,379,560 A * 4/1983 Bakken ..... 415/135
4,679,981 A 7/1987 Guibert et al.
6,164,656 A 12/2000 Frost
6,375,429 B1 4/2002 Halila et al.
6,453,557 B1 9/2002 Burdgick
6,464,453 B2 10/2002 Toborg et al.
6,477,773 B1 11/2002 Wilson et al.
6,769,870 B2 8/2004 De Meo
6,832,892 B2 12/2004 Murphy et al.
6,899,520 B2 5/2005 Habedank et al.
6,939,106 B2 9/2005 Murphy et al.
7,001,145 B2 2/2006 Couture et al.
7,419,355 B2 * 9/2008 Burdgick ..... 415/209.2

FOREIGN PATENT DOCUMENTS

GB 961588 A * 6/1964

* cited by examiner

*Primary Examiner*—Christopher Verdier
(74) *Attorney, Agent, or Firm*—Armstrong Teasdale LLP

(57) ABSTRACT

A method and system for assembling a turbine is provided, wherein an annular nozzle carrier is positioned radially inwardly from a casing such that a cavity is defined between the nozzle carrier and the casing. The method and system also includes a flange that is extended from at least one of a leading edge of the annular casing and a leading edge of the nozzle carrier, and a seal ring that is extended between the nozzle carrier and the casing such that the seal ring seals the cavity, wherein the seal ring is positioned between the flange and at least one of the nozzle carrier and the casing.

20 Claims, 3 Drawing Sheets

METHODS AND SYSTEMS FOR ASSEMBLING A TURBINE

BACKGROUND OF THE INVENTION

This invention relates generally to assembling rotatable machinery and, more particularly, to methods and systems for sealing an extraction cavity in a steam turbine.

At least some known steam turbine designs include static nozzle segments that direct a flow of steam into blades coupled to a rotatable member in the turbine. A nozzle airfoil construction is typically called a diaphragm stage. When more than one nozzle stage is supported by an outer structure or ring, the construction is generally referred to as a nozzle carrier, a "drum construction", or a "carrier construction" flowpath. A nozzle carrier is supported within a turbine casing such that the nozzles are substantially aligned with stages of the turbine blades.

In at least some known turbines, steam is extracted from the low-pressure turbine section for use in other applications. Generally, in steam turbines including a nozzle carrier, steam may only be extracted from the turbine section downstream from a last stage of the carrier. However, in some cases, this extraction location may not be the optimum stage from which steam should be extracted. For example, often a higher pressure or higher temperature steam is desired.

Accordingly, at least some known steam turbines utilize separate carriers within the turbine design to enable steam to be extracted from a location defined between the first and the second carriers. However, utilizing separate carriers may make alignment difficult, as both the carrier and the rotor must be removed to make necessary adjustments. Moreover, utilizing separate carriers generally adds complexity to a turbine design that the carrier is intended to improve. As such, costs and/or time associated with fabrication, assembly, and/or maintenance of the turbine may be increased.

BRIEF DESCRIPTION OF THE INVENTION

In one aspect, a method for assembling a turbine is provided, wherein the method includes positioning an annular nozzle carrier radially inwardly from a casing such that a cavity is defined between the nozzle carrier and the casing. The method also includes extending a flange from at least one of a leading edge of the annular casing and a leading edge of the nozzle carrier, and extending a seal ring between the nozzle carrier and the casing such that the seal ring seals the cavity, wherein the seal ring is positioned between the flange and at least one of the nozzle carrier and the casing.

In another aspect, a turbine is provided, wherein the turbine includes an annular casing and an annular nozzle carrier positioned radially inwardly from the casing such that a cavity is defined therebetween. The turbine also includes a flange extending from at least one of a leading edge of the annular casing and a leading edge of the nozzle carrier, and a seal ring extending between the casing and the nozzle carrier such that the seal ring seals the cavity. The seal ring is positioned between the flange and at least one of the nozzle carrier and the casing.

In a further aspect, an annular component carrier assembly is provided, wherein the carrier assembly is positioned radially inwardly from an annular machine casing such that a cavity is defined therebetween. The assembly includes a flange extending from at least one of a leading edge of the casing and a leading edge of the carrier assembly, and a seal ring extending between the casing and the carrier assembly such that the seal ring seals the cavity. The seal ring is positioned between the flange and at least one of the carrier assembly and the casing.

DETAILED DESCRIPTION OF THE INVENTION

Figure 1:
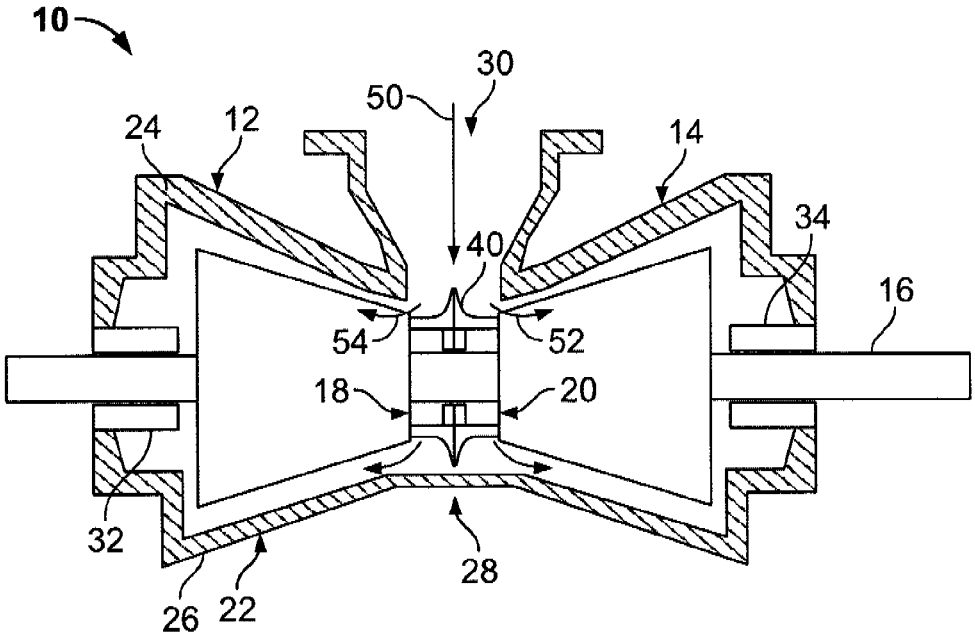
FIG. 1 is a schematic illustration of an exemplary opposed-flow steam turbine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates a double flow low pressure turbine, as will be appreciated by one of ordinary skill in the art, the present invention is not limited to being used with low pressure turbines and can be used with any double flow turbine including, but not limited to intermediate pressure (IP) turbines or high pressure (HP) turbines. In addition, the present invention is not limited to being used with double flow turbines, but rather may also be used with single flow steam turbines as well, for example.

During operation, low pressure steam inlet 30 receives low pressure/intermediate temperature steam 50 from a source, for example, an HP turbine or IP turbine through a cross-over pipe (not shown). Steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed to a condenser, for example.

Figure 2:
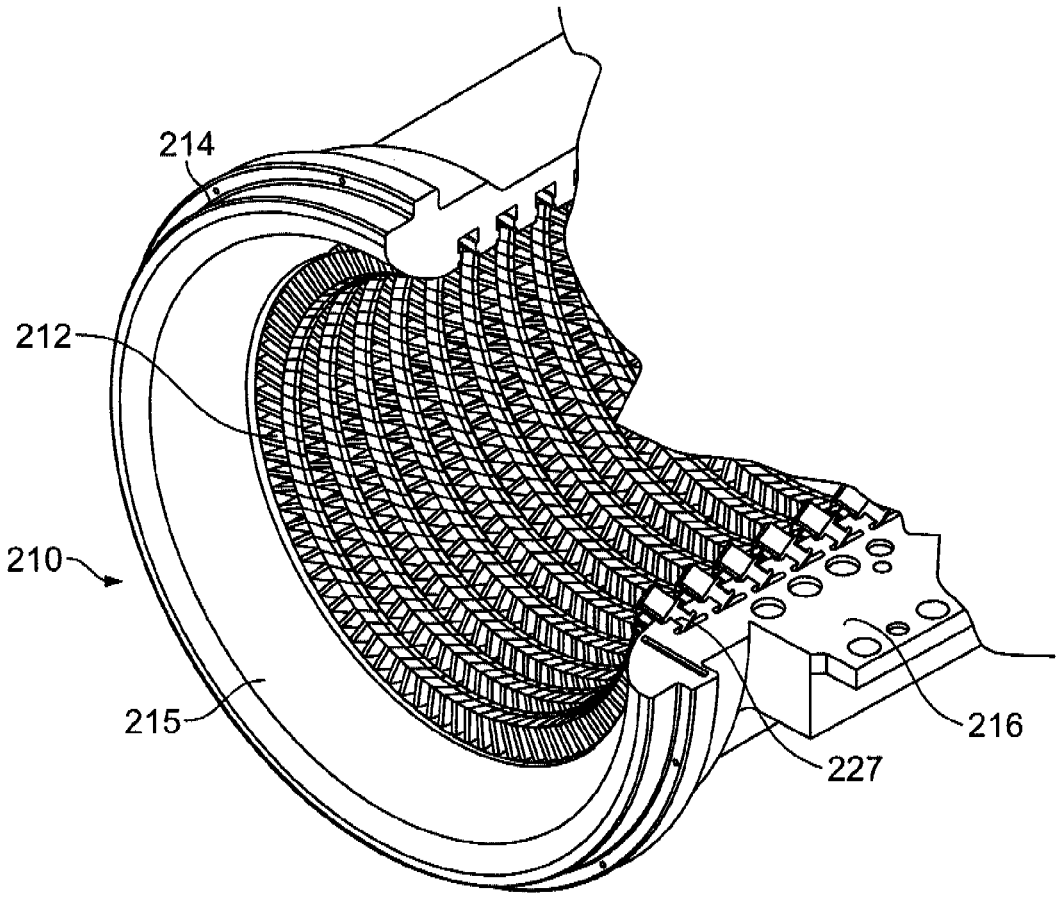
FIG. 2 is a perspective view of an exemplary nozzle carrier that may be used with the turbine shown in FIG. 1.

FIG. 2 is a perspective view of an exemplary nozzle carrier assembly 210 that retains a plurality of stationary nozzles 212 of a turbine, for example, turbine 10. In one embodiment, nozzle carrier assembly 210 is used with a low-pressure turbine section from which extractions are typically taken. In an alternative embodiment, nozzle carrier 210 is used with a high-pressure or intermediate-pressure turbine section. In the exemplary embodiment, carrier 210 includes upper and lower carrier halves 214 and 215, respectively, which are coupled together along a horizontal joint face 216. Nozzles 212 are arranged in an annular array at axially spaced locations along carrier 210. Each circumferentially-spaced array of nozzles 212 includes a plurality of discrete nozzles 212 that are positioned circumferentially against each other. When a rotor (not shown) is rotatably coupled within lower carrier half 215, and after carrier halves 214 and 215 are coupled together, nozzles 212, together with annular arrays of airfoils or buckets extending radially outward from the rotor, form multiple stages of turbine 10. Alternatively, each nozzle stage may also be formed from two half rings that have airfoils machined therein or fabricated into inner and outer portions of the rings to form the stage.

Figure 3:
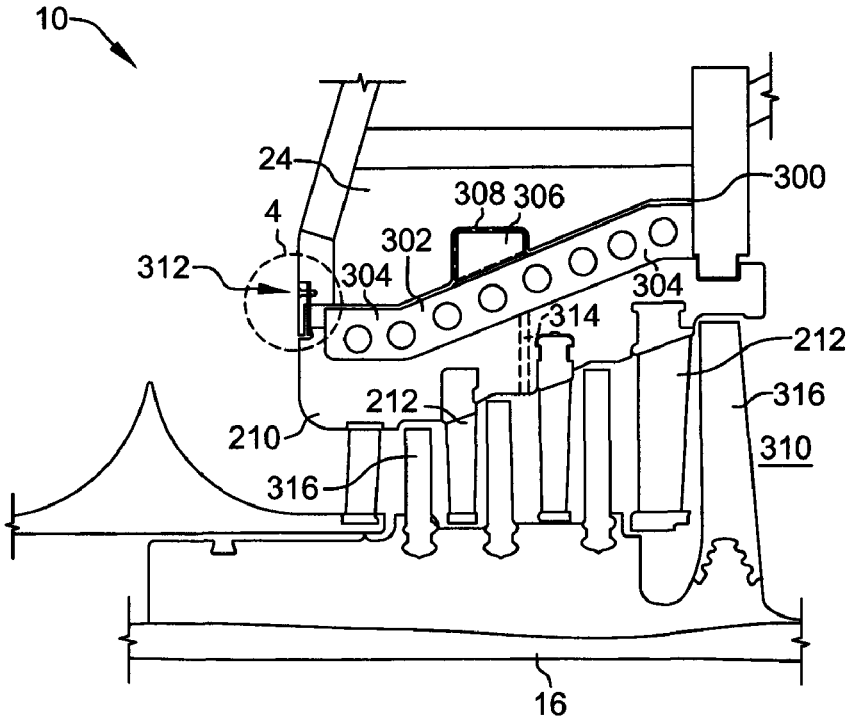
FIG. 3 is a schematic cross-sectional view of a portion of the turbine engine shown in FIG. 1.
Figure 5:
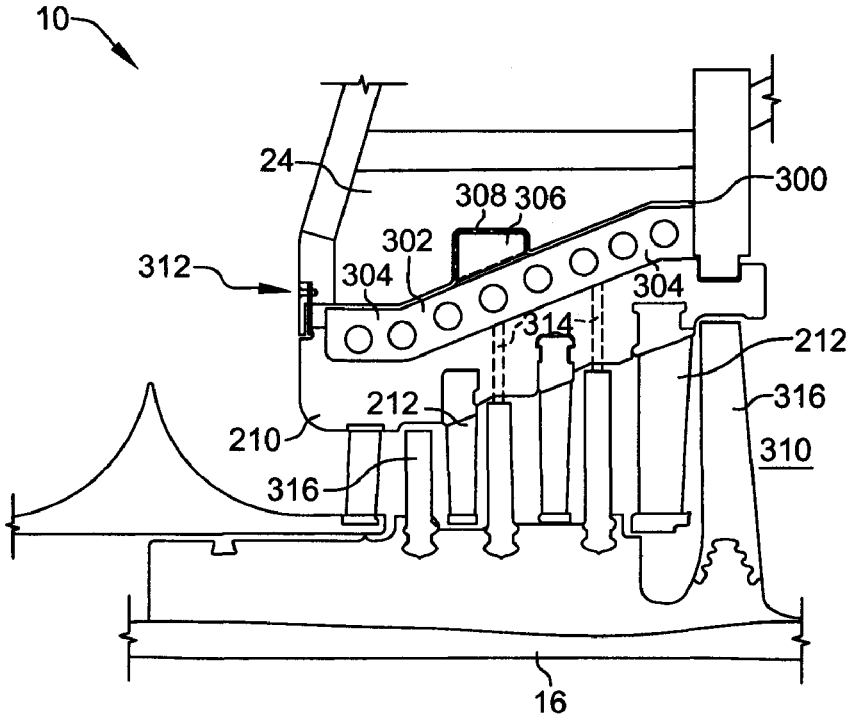
FIG. 5 is a schematic cross-sectional view of an alternative embodiment of a portion of the turbine engine shown in FIG. 1.

FIG. 3 is a schematic cross-sectional view of a portion of turbine engine 10. Turbine engine 10 includes upper half casing 24 that is coupled to a lower half casing (not shown) when turbine engine 10 is fully assembled. Nozzle carrier 210 is positioned radially inwardly from casing 24 such that a cavity 300 is defined therebetween. A gusset structure 302 is positioned within cavity 300 such that a plurality of gussets 304 facilitate providing support between casing 24 and nozzle carrier 210. Gusset structure 302 includes a radial protrusion 306 that is positioned within a notch 308 formed in casing 24 to facilitate preventing axial movement of gusset structure 302 and/or nozzle carrier 210. Furthermore, in the exemplary embodiment, nozzle carrier 210 includes a plurality of nozzles 212 that are positioned to discharge steam from an apparatus, such as a boiler, into a turbine chamber 310. A sealing assembly 312, described in more detail below, is coupled to casing 24 such that sealing assembly 312 is in sealing contact with nozzle carrier 210 to facilitate sealing cavity 300 from the surrounding atmosphere. In an alternative embodiment, sealing assembly 312 is coupled to nozzle carrier 210 and is in sealing contact with casing 24 to facilitate sealing cavity 300 from the surrounding atmosphere.

In the exemplary embodiment, nozzle carrier 210 includes at least one aperture 314 that extends through nozzle carrier 210 from turbine chamber 310 to cavity 300. Moreover, in the exemplary embodiment, aperture 314 is substantially aligned with a stage of rotor blades 316 that is coupled to turbine rotor 16 and is rotatable between adjacent nozzles 212. Accordingly, in the exemplary embodiment aperture 314 extends substantially radially through nozzle carrier 210. The alignment of aperture 314 enables steam to be extracted from rotor blade stage 316. In one embodiment, nozzle carrier 210 includes a plurality of apertures 314 that are each substantially aligned with multiple rotor blade stages 316, such that steam may be extracted from the various stages of rotor blades 316. In another embodiment, nozzle carrier 210 includes a plurality of apertures 314 that are spaced circumferentially around nozzle carrier 210 and aligned with at least one rotor blade stage 316. it should be noted that apertures 314 may be circular, slotted, or any other suitable shape which facilitates steam being extracted from turbine 10. Moreover, in one embodiment, apertures 314 are elongated slots extending circumferentially around nozzle carrier 210. In an alternative embodiment, apertures 314 are a combination of circular openings and other shaped openings including slotted openings.

Figure 4:
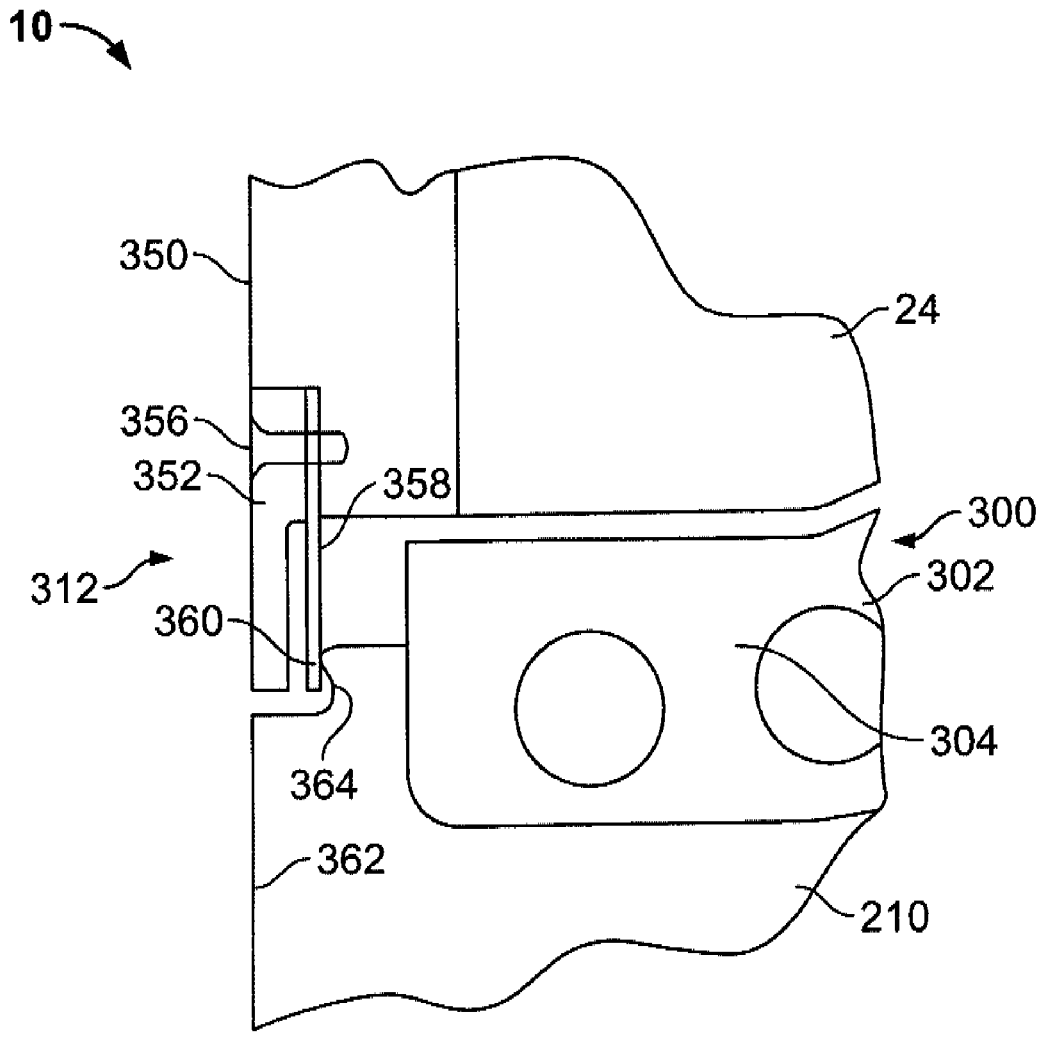
FIG. 4 is an enlarged schematic cross-sectional view of the sealing assembly shown in FIG. 3 and taken along area 4.

FIG. 4 is an enlarged schematic cross-sectional view of sealing assembly 312. Sealing assembly 312 extends from casing 24 to nozzle carrier 210. Specifically, a leading edge 350 of casing 24 includes a flange 352 that extends generally radially inwardly towards nozzle carrier 210 and acts as a flow guide for the surrounding atmosphere. In the exemplary embodiment, flange 352 is coupled to leading edge 350 with a fastening mechanism 356. In another embodiment, flange 352 is coupled to casing 24 using any other suitable coupling mechanism, such as, but not limited to welding. Moreover, in an alternative embodiment, flange 352 and casing 24 are formed together as a unitary piece. An annular sealing ring 358 is coupled between flange 352 and casing 24 and extends radially inwardly towards nozzle carrier 210, such that a radially inner end 360 of sealing ring 358 engages a leading edge 362 of nozzle carrier 210 to facilitate sealing cavity 300. In the exemplary embodiment nozzle carrier leading edge 362 includes a rounded protrusion 364 that is engaged by sealing ring radially inner end 360. Rounded protrusion 364 provides a determinant sealing surface that facilitates accommodating a varying axial alignment between casing 24 and nozzle carrier 210 due to tolerances and transient conditions. In an alternative embodiment, within sealing assembly 312, leading edge 362 is substantially planar and sealing ring radially inner end 360 engages a substantially planar portion of leading edge 362. In the exemplary embodiment, sealing ring 358 is coupled between flange 352 and casing 24 with fastening mechanism 356. In an alternative embodiment, sealing ring 358 is coupled between flange 352 and casing 24 using any other suitable coupling mechanism.

In an alternative embodiment, flange 352 is coupled to, or formed unitarily with, nozzle carrier 210. Moreover, in the alternative embodiment, sealing ring 358 is coupled between flange 352 and nozzle carrier 210 and extends radially outward towards casing 24, such that a radially outer end of sealing ring 358 engages leading edge 350 of casing 24. In such an embodiment, leading edge 350 may be planar, or may include a rounded protrusion, similar to rounded protrusion 364, to facilitate providing a determinant sealing surface that facilitates axial alignment between casing 24 and nozzle carrier 210 due to tolerances and transient conditions. Further, in the alternative embodiment, sealing ring 358 may be coupled between flange 352 and nozzle carrier 210 using any suitable coupling mechanism. In yet another alternative embodiment, turbine engine 10 includes a plurality of sealing rings 358 extending between casing 24 and nozzle carrier 210 at different axial locations.

In one embodiment, sealing ring 358 is formed from two semi-circular members that are coupled together. In an alternative embodiment, sealing ring 358 is formed from an annular member. Moreover, in another alternative embodiment, sealing ring 358 is formed from a plurality of arcuate members coupled together in an overlapping or leafed configuration to form either an annular member or a pair of semi-circular members. In the exemplary embodiment, the two semi-circular members are positioned such that sealing ring 358 extends substantially circumferentially around turbine 10. In addition, in the exemplary embodiment, sealing ring 358 is fabricated from a flexible material that facilitates accommodating thermal and/or axial growth of casing 24 and/or nozzle carrier 210. For example, in one embodiment, sealing ring 358 is fabricated from a 12Cr (410SS) material or 310SS (stainless steel). In an alternative embodiment, sealing ring 358 is fabricated from a cobalt based material to facilitate improving wear of sealing ring 358.

During operation, steam is discharged from nozzles 212 into turbine chamber 310 to cause rotation of turbine rotor 16. As steam is channeled through the turbine stages, a portion of steam is extracted from turbine 10 for use in other turbine operations or operations discrete from the turbine operation. Specifically, steam is extracted through apertures 314 and channeled into cavity 300. Sealing assembly 312 enables steam to be retained within cavity 300 such that steam is not lost through gaps formed between casing 24 and nozzle carrier 210. Steam within cavity 300 is channeled through ports defined in casing 24 and is used to operate machinery outside of turbine 10.

Sealing assembly 312 facilitates sealing cavity 300 at the leading edges of casing 24 and nozzle carrier 210 such that leakage is substantially prevented. As such, steam can be extracted into, and retained within, cavity 300, rather than only being extracted from a downstream end of turbine 10, or from a juncture created between a pair of adjacent nozzle carriers. By enabling cavity 300 to receive steam, without the steam being lost through gaps defined between casing 24 and nozzle carrier 210, steam may be extracted at any location throughout nozzle carrier 210. Specifically, steam may be extracted at any location through apertures 314, and apertures 314 may be positioned at any stage of turbine 10. As such, steam at a higher pressure and/or a higher temperature may be extracted from a turbine including a unitary nozzle carrier. Moreover, using a plurality of apertures 314 enables steam to be extracted from varying stages of turbine 10 at varying temperatures and pressures. As a result, turbine assembly, maintenance, and operation costs are recovered in comparison to other turbines. In addition, by utilizing a single nozzle carrier, time and costs associated with nozzle carrier alignment are reduced in comparison to other turbines.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a nozzle carrier and seal for a steam turbine, it is understood that the apparatus and methods are not limited to nozzle carriers, seals or steam turbines. Likewise, the nozzle carrier and seal components illustrated are not limited to the specific embodiments described herein, but rather, components of the nozzle carrier and seal can be utilized independently and separately from other components described herein. For example, as will be appreciated by one of ordinary skill in the art, the present invention may be used with any suitable rotatable machine.

While the invention has been described in terms of various specific embodiments, those skilled in the art will recognize that the invention can be practiced with modification within the spirit and scope of the claims.

What is claimed is:

1. A method for assembling a turbine, said method comprising:

positioning an annular nozzle carrier radially inwardly from a casing such that a cavity is defined between the nozzle carrier and the casing;

positioning a gusset structure within the cavity to couple the casing to the annular nozzle carrier, such that the gusset structure provides support between the casing and the annular nozzle carrier;

coupling a flange to the casing, such that said flange extends from a leading edge of the casing towards a leading edge of the nozzle carrier; and extending a seal ring between the nozzle carrier and the casing such that the seal ring seals the cavity, wherein the seal ring is positioned between the flange and at least one of the nozzle carrier and the casing, wherein the seal ring extends from the casing leading edge towards the nozzle carrier leading edge.

2. A method in accordance with claim 1 further comprising coupling a plurality of overlapped sections together to form the seal ring.

3. A method in accordance with claim 1 wherein said extending a seal ring between the nozzle carrier and the casing further comprises extending a seal ring fabricated from a flexible material between the nozzle carrier and the casing to facilitate accommodating thermal growth of at least one of the nozzle carrier and the casing.

4. A method in accordance with claim 1 further comprising forming at least one aperture that extends substantially radially through the nozzle carrier.

5. A method in accordance with claim 4 wherein forming at least one aperture further comprises forming an elongated slot that extends substantially radially through the nozzle carrier.

6. A method in accordance with claim 4 further comprising forming a plurality of circumferentially-spaced apertures around the nozzle carrier.

7. A method in accordance with claim 4 further comprising substantially aligning the at least one aperture with a stage of turbine rotor blades.

8. A turbine comprising:

an annular casing;

an annular nozzle carrier positioned radially inwardly from said casing such that a cavity is defined therebetween;

a gusset structure positioned within said cavity to couple said annular casing to said annular nozzle carrier, such that said gusset structure provides support between said annular casing and said annular nozzle carrier;

a flange coupled to a leading edge of said annular casing, said flange extending radially inward from said annular casing towards a leading edge of said nozzle carrier; and a seal ring extending between said casing and said nozzle carrier such that said seal ring seals said cavity, wherein said seal ring is positioned between said flange and at least one of said nozzle carrier and said casing, said seal ring extends radially from said casing leading edge towards said nozzle carrier leading edge.

9. A turbine in accordance with claim 8 wherein said seal ring comprises a plurality of overlapped sections.

10. A turbine in accordance with claim 8 wherein said seal ring comprises a flexible material that accommodates thermal growth of at least one of said nozzle carrier and said casing.

11. A turbine in accordance with claim 8 wherein said nozzle carrier comprises at least one aperture extending substantially radially therethrough.

12. A turbine in accordance with claim 11 wherein said at least one aperture comprises an elongated slot.

13. A turbine in accordance with claim 11 wherein said at least one aperture comprises a plurality of apertures spaced circumferentially around said nozzle carrier.

14. A turbine in accordance with claim 11 further comprising at least one stage of rotor blades, said at least one aperture is substantially aligned with one of said rotor blades.

15. An annular component carrier assembly positioned radially inwardly from an annular machine casing such that a cavity is defined therebetween, said assembly comprising:

a gusset structure positioned within said cavity to couple said annular machine casing to said annular component carrier, such that said gusset structure provides support between said casing and said carrier;

a flange coupled to a leading edge of the casing, said flange extending radially from said casing towards a leading edge of said carrier assembly; and a seal ring extending between the casing and said carrier assembly such that said seal ring seals said cavity, wherein said seal ring is positioned between said flange and at least one of said carrier assembly and the casing, said seal ring extending radially from a leading edge of said casing towards said carrier leading edge.

16. An assembly in accordance with claim 15 wherein said seal ring comprises a plurality of overlapped sections.

17. An assembly in accordance with claim 15 wherein said seal ring comprises a flexible material that accommodates thermal growth of at least one of said component carrier and said casing.

18. An assembly in accordance with claim 15 wherein said carrier assembly comprises at least one aperture extending substantially radially therethrough.

19. An assembly in accordance with claim 15 wherein said at least one aperture comprises an elongated slot substantially aligned with a rotatable member of the machine.

20. An assembly in accordance with claim 15 comprising a plurality of apertures spaced circumferentially around said carrier assembly, each of said plurality of apertures is substantially aligned with a rotatable member of the machine.

* * * * *